US006112817A

United States Patent [19]

Voll et al.

[11] Patent Number: 6,112,817

[45] Date of Patent: Sep. 5, 2000

[54] FLOW CONTROL APPARATUS AND METHODS

[75] Inventors: Benn Voll, Houston; Michael H. Johnson, Flower Mound; John W. Harrell, Spring, all of Tex.

[73] Assignee: Baker Hughes Incorporated, Houston, Tex.

[21] Appl. No.: 09/073,328

[22] Filed: May 6, 1998

Related U.S. Application Data

[60] Provisional application No. 60/045,718, May 6, 1997.

[51] Int. Cl.[7] ..... E21B 43/12

[52] U.S. Cl. ..... 166/370; 166/373; 166/91.1

[58] Field of Search ..... 166/74, 88.4, 91.1, 166/233, 236, 231, 250.01, 373, 370, 332.5

[56] References Cited

U.S. PATENT DOCUMENTS

| | | | |
|---|---|---|---|
| 2,005,767 | 6/1935 | Zublin | 166/74 |
| 2,277,380 | 3/1942 | Yancey | 166/74 |
| 5,186,255 | 2/1993 | Corey . | |
| 5,295,538 | 3/1994 | Restarick . | |
| 5,355,953 | 10/1994 | Shy et al. . | |
| 5,435,393 | 7/1995 | Brekke et al. . | |
| 5,445,225 | 8/1995 | Wiggins, Sr. . | |
| 5,531,270 | 7/1996 | Fletcher et al. . | |
| 5,597,042 | 1/1997 | Tubel et al. . | |
| 5,803,179 | 9/1998 | Echols et al. | 166/370 |
| 5,890,533 | 4/1999 | Jones | 166/51 |

FOREIGN PATENT DOCUMENTS

WO 92/08875 5/1992 WIPO .

*Primary Examiner*—Frank Tsay
*Attorney, Agent, or Firm*—Madan, Mossman & Sriram, P.C.

[57] ABSTRACT

The present invention provides a method for obtaining equalized production from deviated wellbores. A plurality of spaced apart flow control device are deployed along the length of the wellbore. The fluid from various zones are drawn in a manner that depletes the reservoir uniformly along the entire length of the wellbore. Each flow control device is initially set at a rate determined from initial reservoir simulations or models. The depletion rate, water, oil and gas content, pressure, temperature and other desired parameters are determined over a time period. This data is utilized to update the initial reservoir model, which in turn is utilized to adjust the flow rate from one or more zones so as to equalize the flow rate from the reservoir. The present invention also provides a flow control device which includes an outer shroud that reduces the effect of fluid impact on the flow control device and one or more tortuous paths which carry the formation fluid into the production tubing. A control unit controls the flow output from the flow control device. The control unit may communicate with surface equipment or act autonomously to take actions downhole based on programmed instructions provided to the control unit.

17 Claims, 6 Drawing Sheets

Horizontal Well with Permeabilty Contrasts and Shale

The well has been drilled, logged and geophysical map has been created

Reservoir Inflow Control Device Is Run In Place

Reservoir Inflow Control Device Is Installed
And Production Liner Can Be Run

FLOW CONTROL APPARATUS AND METHODS

CROSS REFERENCE TO RELATED APPLICATION

This application takes priority from U.S. patent application Ser. No. 60/045,718, filed on May 6, 1997.

BACKGROUND OF THE INVENTION

1. Field of the Invention

This invention relates generally to methods of producing hydrocarbons from wellbores formed in subsurface formations and more particularly to apparatus and methods for regulating and/or equalizing production from different zones of a wellbore to optimize the production from the associated reservoirs or pay zones.

2. Background of the Art

To produce hydrocarbons from earth formations, wellbores are drilled into reservoirs or pay zones. Such wellbores are completed and perforated at one or more zones to recover hydrocarbons from the reservoirs. Horizontal wellbores are now frequently formed into a pay zone to increase production and to obtain on the aggregate higher quantities of the hydrocarbons from such reservoirs.

Sand screens of various designs and slotted liners are commonly placed between the formation and a tubing (production tubing) in the wellbore, which transports formation fluid to the surface to prevent entry of sand and other solid particulates into the tubing. Screens of different sizes and configuration are commonly used as sand control devices. The prior art screens typically erode substantially over time. The present invention provides a screen which is less susceptible to erosion compared to prior art screens.

Excessive fluid flow rates from any production zone can cause, among other things, excessive pressure drop between the formation and the wellbore casing, relatively quick erosion of inflow devices, water or gas coning, caving, etc. Therefore, to avoid such problems, fluid flow from each production zone is controlled or regulated. Several flow control devices have been utilized for regulating or controlling production of formation fluids. One recent device passes the formation fluid through a spiral around a tubular to reduce the pressure drop before the fluid is allowed to enter the tubing. The spiral provides a tortuous path, which can be plugged at one or more places to adjust the fluid flow from the formation to the tubing. This device, although effective, must be set at the surface prior to its installation. U.S. patent application Ser. No. 08/673,483 to Coon, filed on Jul. 1, 1996, and assigned to the assignee of this application, discloses an electrically operable sliding sleeve for controlling fluid flow through a tortuous path. This sliding sleeve may be operated from the surface. U.S. application Ser. No. 08/673,483 is incorporated herein by reference. The present invention provides a flow control device that can be opened, closed or set at any intermediate flow rate from the surface. It also includes multiple fluid paths, each of which may be independently controlled to control the formation-fluid flow into the tubing.

In vertical wellbores, several zones are produced simultaneously. In horizontal wellbores, the wellbore may be perforated at several zones, but is typically produced from one zone at a time. This is because the prior art methods are not designed to equalize flow from the reservoir throughout the entire wellbore. Further, the prior art methods attempt to control pressure drops and not the fluid flows from each of the zones simultaneously.

The present invention provides methods for equalizing fluid flow from multiple producing zones in a horizontal wellbore. Each production zone may be independently controlled from the surface or downhole. This invention also provides an alternative system wherein fluid flow from various zones is set at the surface based on reservoir modeling and field simulations.

SUMMARY OF THE INVENTION

The present invention provides a fluid flow control device for controlling the formation-fluid flow rate through a production string. The device includes a generally tubular body for placement into the wellbore. The tubular body is lined with a sand screen and an outer shroud. The shroud reduces the amount of fluid that directly impacts the outer surface of the screen, thereby reducing the screen erosion and increasing the screen life. The fluid from the screen flows into one or more tortuous paths. Each tortuous path has an associated flow control device, which can be activated to independently open or close each tortuous path. Alternatively, flow from each path may be regulated to a desired rate.

Each flow control device further may include a control unit for controlling the output of the flow control device. The control unit may communicate with a surface control unit, which is preferably a computer-based system. The control unit performs two-way data and signal communication with the surface unit. The control unit can be programmed to control its associated device based on command signals from the surface unit or based on programs stored in the control unit. The communication may be via any suitable data communication link including a wireline, acoustic and electromagnetic telemetry system. Each flow control device may be independently controlled without interrupting the fluid flow through the production string. The flow control devices may communicate with each other and control the fluid flow based on instructions programmed in their respective control units and/or based on command signals provided from the surface control unit.

In a preferred method, a plurality of spaced apart flow control device are deployed along the length of the horizontal wellbore. In one method of the invention, it is preferred to draw fluids from various zones in a manner that will deplete the reservoir uniformly along the entire length of the wellbore. To achieve uniform depletion, each flow control device is initially set at a rate determined from initial reservoir simulations or models. The depletion rate, water, oil and gas content, pressure, temperature and other desired parameters are determined over a time period. This data is utilized to update the initial reservoir model, which in turn is utilized to adjust the flow rate from one or more zones so as to equalize the flow rate from the reservoir.

In an alternative method, production zones are defined and flow setting for each zone is fixed at the surface prior to installation of the flow control devices. Such a system is relatively inexpensive but would only partially equalize the production from the reservoir as it would be based on a priori reservoir knowledge.

The present invention provides a method of producing hydrocarbons from a reservoir having a deviated/substantially horizontal wellbore formed therein, said method, comprising: (a) placing a plurality of flow control devices in the wellbore, each flow control device set to produce formation fluid at an initial rate associated with each such flow control device; (b) determining at least one characteristic of the fluid produced through the wellbore; and (c) adjusting the flow rate through said flow control devices so as to equalize depletion of hydrocarbons from the reservoir over a time period.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals, and wherein.

DETAILED DESCRIPTION OF PREFERRED EMBODIMENTS

Figure 1:
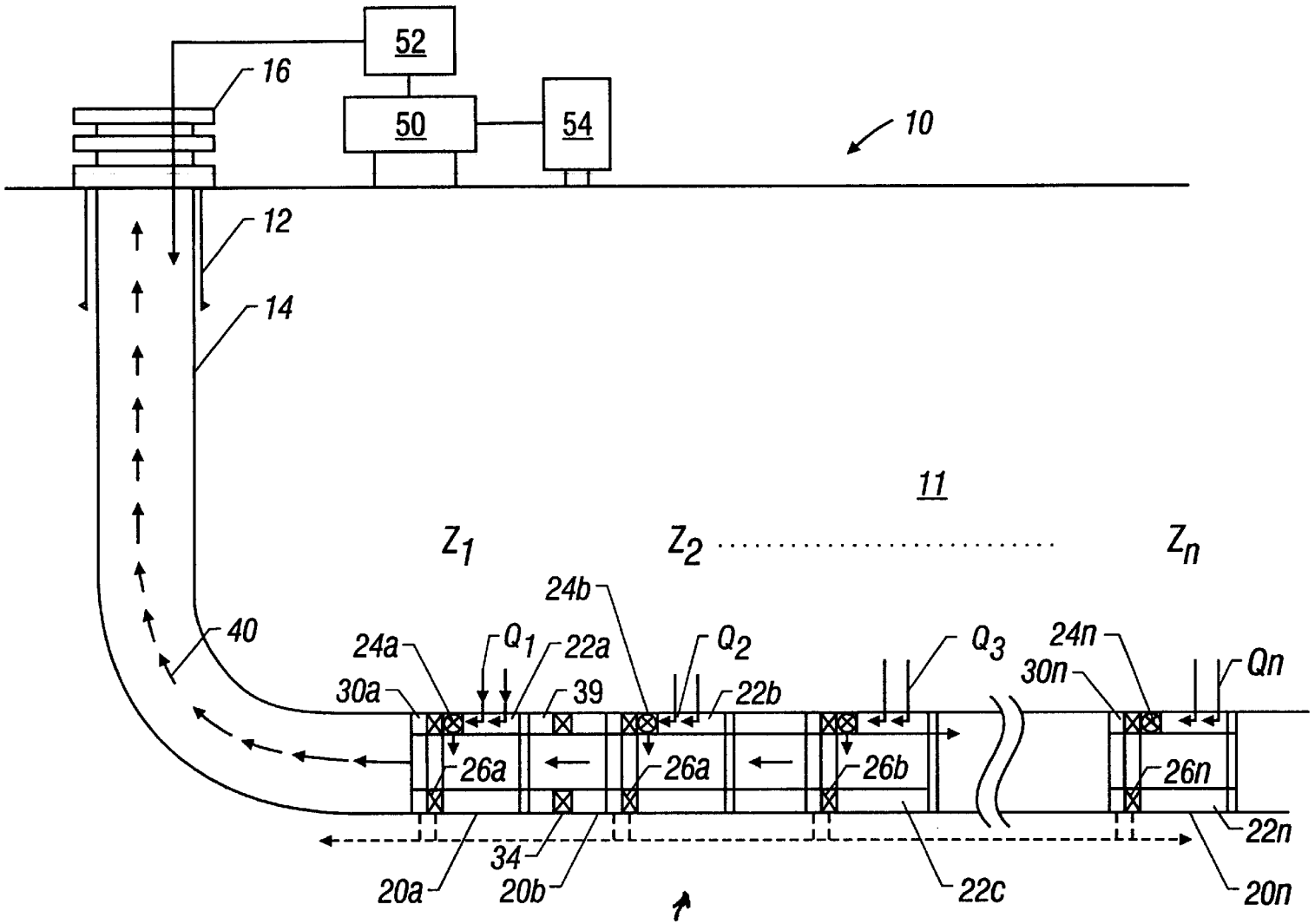
FIG. 1 shows a horizontal wellbore having a plurality of spaced apart flow control devices for producing hydrocarbons from a reservoir according to one method of the present invention.

FIG. 1 is a schematic illustrating a system 10 for producing hydrocarbons from a wellbore according to one method of the present invention. FIG. 1 shows a wellbore 14 having an upper casing 12 formed in an earth formation 11 according to any known method. A plurality of fluid flow devices or fluid flow devices 20*a–n* are placed spaced apart in the horizontal segment 14*a* of the wellbore 14. For the purposes of this disclosure, a flow control device is generally designated by numeral 20. The construction and operation of a novel flow control device for use as the flow control devices 20 are described below in reference to FIGS. 2A–B. However, for the purpose of this invention, any suitable flow control device may also be used. The spacings between the flow control devices 20 are determined based on the characteristics of the reservoir 11, as described in more detail later.

Each flow control device 20*a–n* includes a flow valve and a control unit. The devices 20*a–n* are respectively shown to contain flow regulation devices such as valves, valves 24*a–n* and control units 26*a–n*. For the purposes of this invention, a flow control device is generally designated by numeral 24 and a control unit is generally designated by numeral 26. Also, for the purpose of this invention, flow control valves 24 shall mean to include any device that is utilized to control the flow of fluid from the reservoir 11 into the wellbore 14 and control units 26 shall mean to include any circuit or device that controls the flow valves 24.

When the wellbore is in production phase, fluid 40 flows from the formation 11 into channels 22*a–*22*n* at each flow control device, as shown by the arrow 22*a'–*22*n'*. The flow rate through any flow control devices 20 will depend upon the setting of its associated flow control valve 24. For the purpose of illustration, the flow rates associated with the flow control devices 20*a–*20*n* are respectively designated by $Q_1$–$Q_n$ corresponding to production zones $Z_1$–$Z_n$ of the formation 11.

Still referring to FIG. 1, each flow control device 20*a–*20*n* or zone $Z_1$–$Z_n$ may have any number of devices and sensors for determining selected formation and wellbore parameters. Elements 30*a–*30*n* respectively represent such devices and sensors corresponding to flow control devices 20*a–*20*n* or zones $Z_1$–$Z_n$. Such devices and sensors are generally designated by numeral 30. Devices and sensors 30 preferably include temperature sensors, pressure sensors, differential pressure sensors for providing the pressure drop between selected locations corresponding to the production zones $Z_1$–$Z_n$, flow rate devices, and devices for determining the constituents (oil, gas and water) of the formation fluid 40. Packers 34 may be selectively placed in the wellbore 14 to prevent the passage of the fluids through the annulus 39 between adjacent sections.

The control units 26*a–*26*n* control the operation of their associated flow control valves 24*a–*24*n*. Each control unit 26 preferably includes programmable devices, such as microprocessors, memory devices and other circuits for controlling the operation of the flow control devices 20 and for communicating with other sensors and devices 30. The control units 26 also may be adapted to receive signals and data from the devices and sensors 30 and to process such information to determine the downhole conditions and parameters of interest. The control units 26 can be programmed to operate their corresponding flow control devices 20 based upon stored programs or commands provided from an external unit. They preferably have a two way communication with a surface control system 50. The surface control system 50 preferably is a computer-based system and is coupled to a display and monitor 52 and other peripherals, generally referred to by numeral 54, which may include a recorder, alarms, satellite communication units, etc.

Prior to drilling any wellbore, such as the wellbore 12, seismic surveys are made to map the subsurface formations, such as the formation 11. If other wellbores have been drilled in the same field, well data would exist for the field 11. All such information is preferably utilized to simulate the condition of the reservoir 11 surrounding the wellbore 14. The reservoir simulation or model is then utilized to determine the location of each flow control device 20 in the wellbore 14 and the initial flow rates $Q_1$–$Q_n$. The flow control devices 20*a–*20*n* are preferably set at the surface to produce formation fluids therethrough at such initial flow rates. The flow control devices 20*a–*20*n* are then installed at their selected locations in the wellbore 14 by any suitable method known in the art.

The production from each flow control device 20 achieves a certain initial equilibrium. The data from the devices 30*a–*30*n* is processed to determine the fluid constituents, pressure drops, and any other desired parameters. Based on the results of the computed parameters, the initial or starting reservoir model is updated. The updated model is then utilized to determine the desired flow rates for each of the zones $Z_1$–$Z_n$ that will substantially equalize the production from the reservoir 11. The flow rate through each of the flow control devices 20*a*–20*n* is then independently adjusted so as to uniformly deplete the reservoir. For example, if a particular zone starts to produce water at more than a preset value, the flow control device associated with such zone is activated to reduce the production from such zone. The fluid production from any zone producing mostly water may be completely turned off. This method allows manipulating the production from the reservoir so as to retrieve the most amount of hydrocarbons from a given reservoir. Typically, the flow rate from each producing zone decreases over time. The system of the present invention makes it possible to independently and remotely adjust the flow of fluids from each of the producing zones, without shutting down production.

The control units 26*a*–26*n* may communicate with each other and control the fluid flow through their associated flow control devices to optimize the production from the wellbore 14. The instructions for controlling the flow may be programmed in downhole memory (not shown) associated with each such control unit or in the surface control unit 50. Thus, the present invention provides a fluid flow control system 10, wherein the flow rate associated with a number of producing zones $Z_1$–$Z_n$ may be independently adjusted, without requiring physical intervention, such as a shifting device, or requiring the retrieval of the flow control device or requiring shutting down production.

The surface control unit 50 may be programmed to display on the display unit 52 any desired information, including the position of each flow control valve 24*a*–24*n*, the flow rate from each of the producing zones $Z_1$–$Z_n$, oil/water content or oil and gas content, pressure and temperature of each of the producing zones $Z_1$–$Z_n$, and pressure drop across each flow control device 20*a*–20*n*.

Still referring to FIG. 1, as noted above, the system 10 contains various sensors distributed along the wellbore 14, which provide information about the flow rate, oil, water and gas content, pressure and temperature of each zone $Z_1$–$Z_n$. This information enables determination of the effect of each production zone $Z_1$–$Z_n$ on the reservoir. 11 and provides early warnings about potential problems with the wellbore 14 and the reservoir 11. The information is also utilized to determine when to perform remedial work, which may include cleaning operations and injection operations. The system 10 is utilized to determine the location and extent of the injection operations and also to monitor the injection operations. The system 10 can be operated from the surface or made autonomous, wherein the system obtains information about downhole parameters of interest, communicate information between the various devices, and takes the necessary actions based on programmed instructions provided to the downhole control units 26*a*–26*n*. The system 10 may be designed wherein the downhole control units 16*a*–16*n* communicate selected results to the surface, communicate results and data to the surface or operate valves 24*a*–24*n* and 30*a*–30*n* based on commands received from the surface unit 50.

Figure 2A:
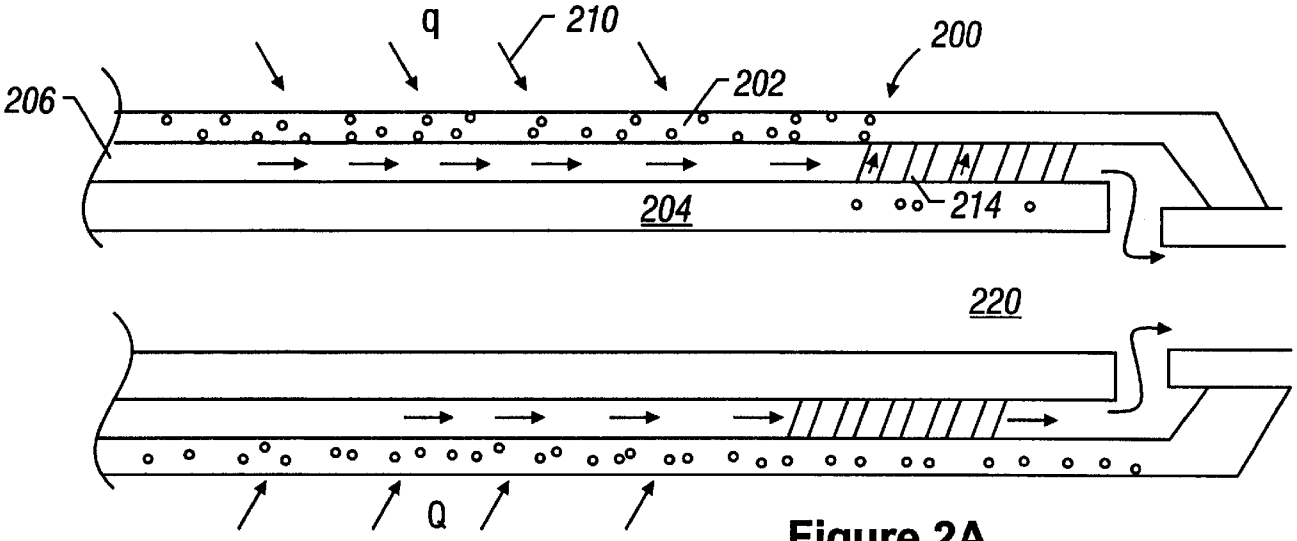
FIG. 2A shows a partial schematic view of a flow control device for use in the system shown in FIG. 1.

FIG. 2A shows a partial schematic view of a flow control device 200 for use in the system of FIG. 1. The device 200 has an outer sand control element 202 and an inner cylindrical member 204 together forming a fluid channel 206 therebetween. Formation fluid enters the channel 206 via the sand control element 202. The channel 206 delivers the formation fluid 210 to one or more spiral tubings or conduits 214 or tortuous paths, which reduce the pressure drop between the inlet and the outlet of the spiral tubings 214. The fluid 210 leaving the tubings 214 is discharged into the production tubing 220 from where it is transported to the surface.

Figure 2B:
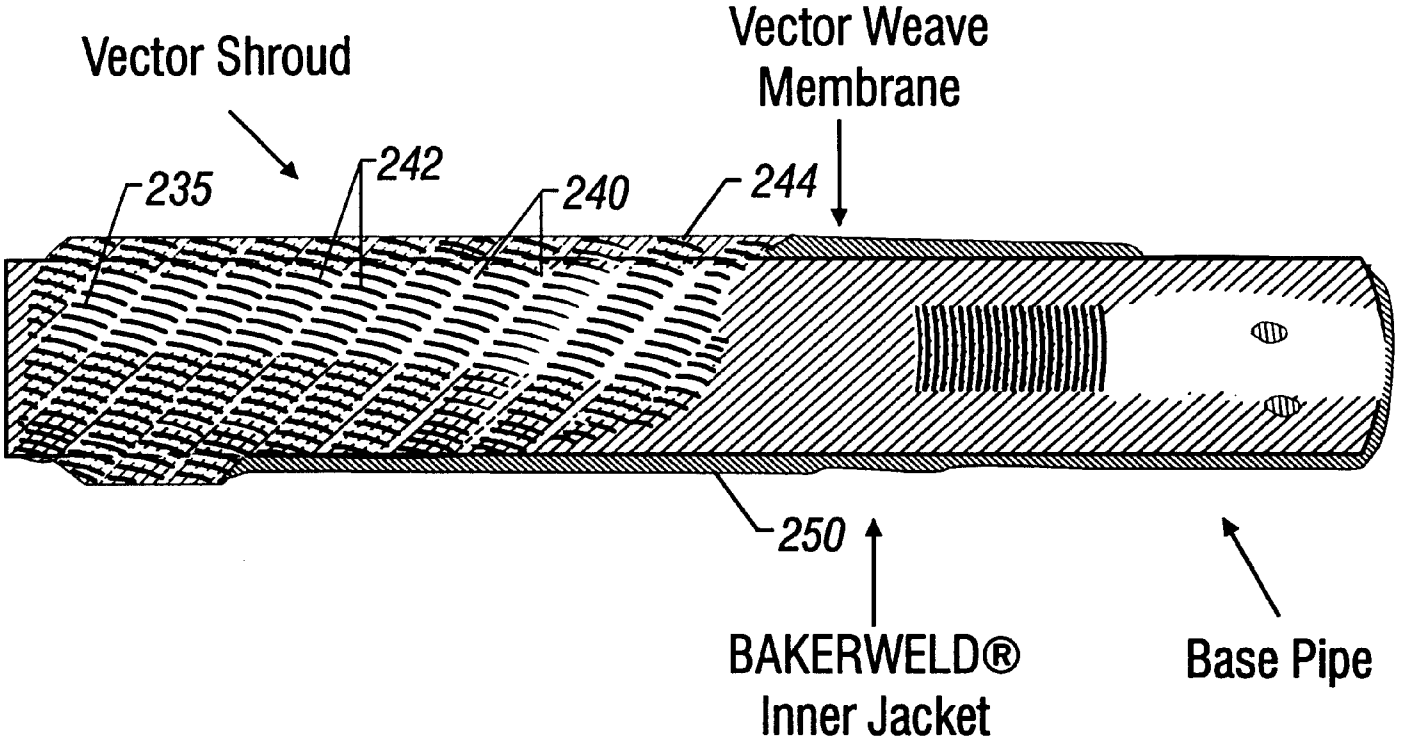
FIG. 2B shows a partial cut off view of a sand control section for use with the flow control device of FIG. 2A.

FIG. 2B shows a partial cut-off view of a sand control section 235 for use with the flow control device 200 of FIG. 2A. It includes an outer shroud 235 which has alternating protruded surfaces 240 and indented or receded surfaces 242. The protruded surfaces 240 have sides 244 cut at an angle providing a vector design. This vector design inhibits the impact effect of the formation fluid on the shroud 235 and the screen 250, which is disposed inside the shroud 235.

Figure 3:
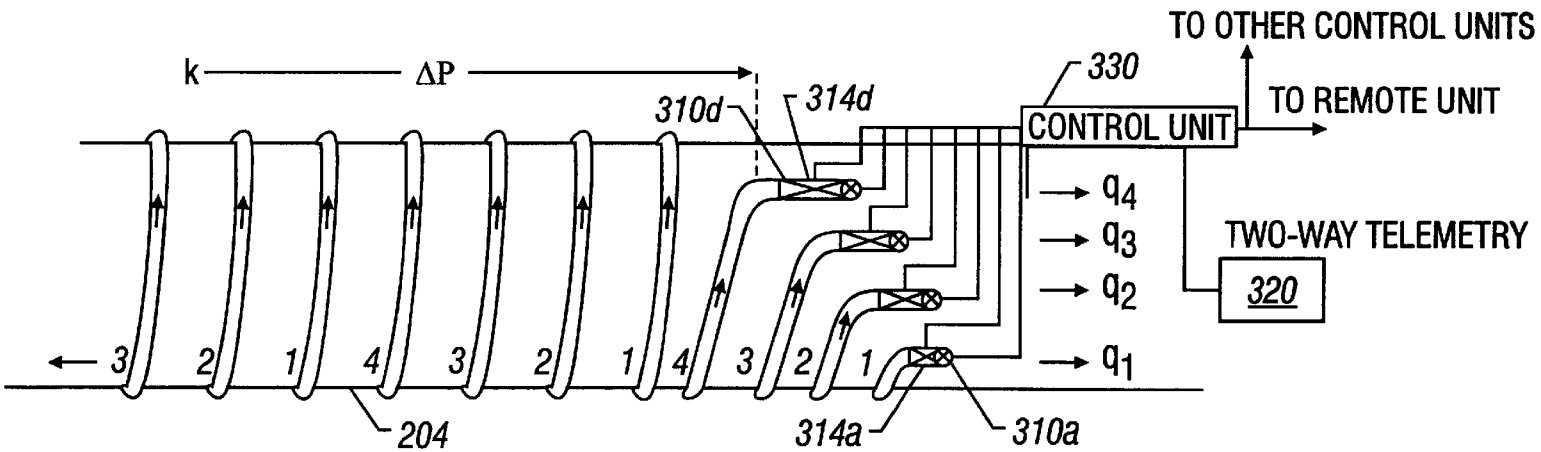
FIG. 3 shows control devices and certain sensors for use with the flow control device of FIG. 2A.

FIG. 3 is a schematic illustration showing a control unit for controlling the flow through the flow control device 200 of FIG. 2. FIG. 3 shows four tubings 214 numbered 1–4 and helically placed around the tubular device 204 (FIG. 2A). The tubings 1–4 may be of different sizes. A flow control device at the output of each of the tubings 1–4 controls the fluid flow through its associated tubing. In the example of FIG. 3, valves 310*a*–310*d* respectively control flow through tubings 1–4. A common flow control device (not shown) may be utilized to control the flow of fluid through the tubings 1–4. Flow meters and other sensors, such as temperature sensors, pressure sensors etc. may be placed at any suitable location in the device 200. In FIG. 3, flow measuring devices 314*a*–314*d* are shown disposed at the tubing 1–4 outlets. The output from the tubings 1–4 is respectively shown by $q_1$–$Q_4$. A suitably disposed control unit 330 controls the operation of the valves 310*a*–310*d* and receives information from the devices 314*a*–314*d*. The control unit 330 also processes information from the various suitably disposed devices and sensors 320 that preferably include: resistivity devices, devices to determine the constituents of the formation fluid, temperature sensors, pressure sensors and differential pressure sensors, and communicates such information to other devices, including the surface control unit 50 (FIG. 1) and other control units such as control units 26*a*–26*n* (FIG. 1).

Figure 4:
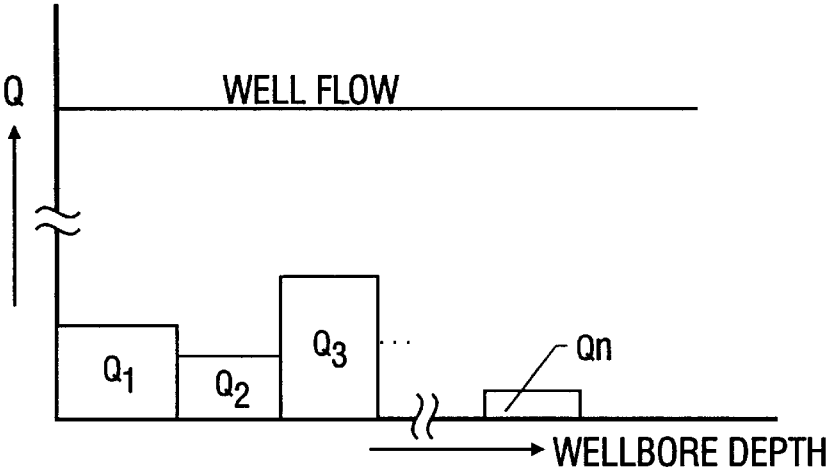
FIG. 4 shows a hypothetical graph showing the flow rate from various zones of a horizontal wellbore according to one method of the present invention.
Figure 5:
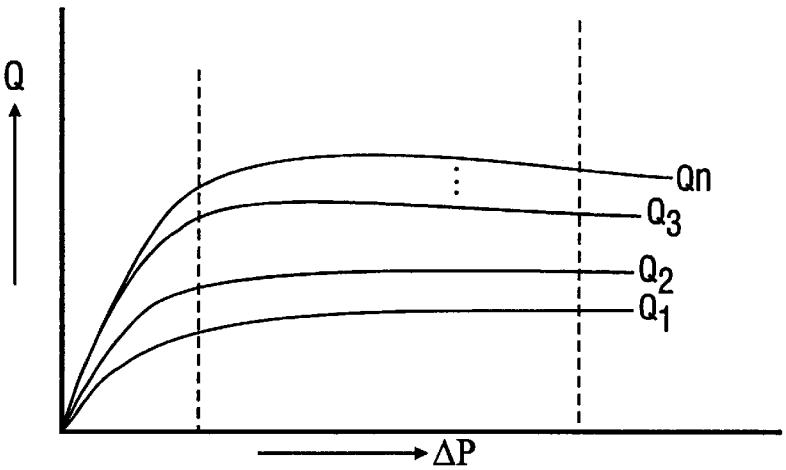
FIG. 5 shows a relationship between the pressure differential and the flow rate associated with various production zones of a wellbore.

FIGS. 4 and 5 illustrate examples of flow rates from multiple reservoir segments. In FIGS. 4 and 5, the flow rates $Q_1$–$Q_n$ correspond to the zones $Z_1$–$Z_n$ shown in FIG. 1. The actual flow rates are determined as described above. By manipulating the flow rates $Q_1$–$Q_n$, optimum flow rate profile for the reservoir can be obtained. The total reservoir flow rate Q shown along the vertical axis is the sum of the individual flow rates $Q_1$–$Q_n$. Here the fluid regulating device (such as 310*a*–310*n*, FIG. 7) utilized to control the fluid discharge from the tortuous path operates at a fluid velocity where the fluid flow from the formation is substantially insensitive to pressure changes in the formation near the flow control device and, thus, acts as a control valve for controlling the fluid discharge from the formation. This is shown by the position between dotted lines in FIG. 5, where $\Delta p$ is the pressure drop.

Figure 6:
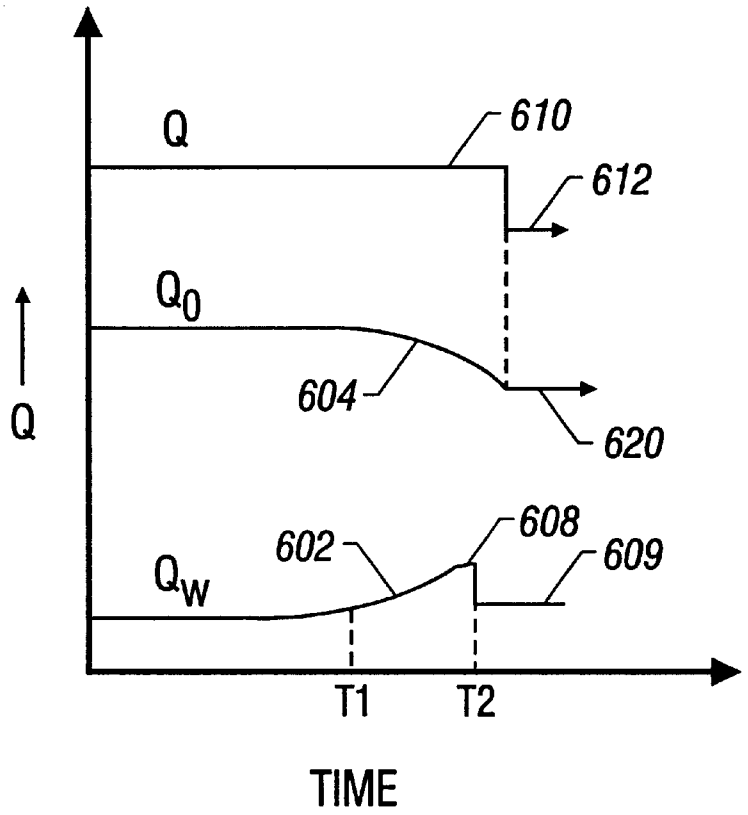
FIG. 6 shows a scenario relating to the effect of adjusting the flow rate from a production zone on production of hydrocarbons and water from such zone.

FIG. 6 shows how adjusting the flow rate Q can reduce or eliminate production of unwanted fluids from the reservoir. It shows the potential impact of adjusting the flow rate on the production of constituents of the formation fluid. $Q_0$ denotes the oil flow rate and $Q_w$ denotes the water flow rate from a particular zone. As the formation fluid flow continues over time, the water production $Q_w$ may start to increase at time $T_1$ and continue to increase as shown by the curved section 602. As the water production increases, the oil production decreases, as shown by the curved sections 604. The system of the present invention would adjust the flow rate, i.e., increase or decrease the production so as to reduce the water production. The example of FIG. 6 shows that decreasing the overall production Q from level 610 to 612 reduces the water production from level 608 to level 609 and stabilizes the oil production at level 620. Thus, in the present invention, the overall production from a reservoir is optimized by manipulating the production flows of the various production zones. The above described methods equally apply to production from multi-lateral wellbores.

Figure 7A:
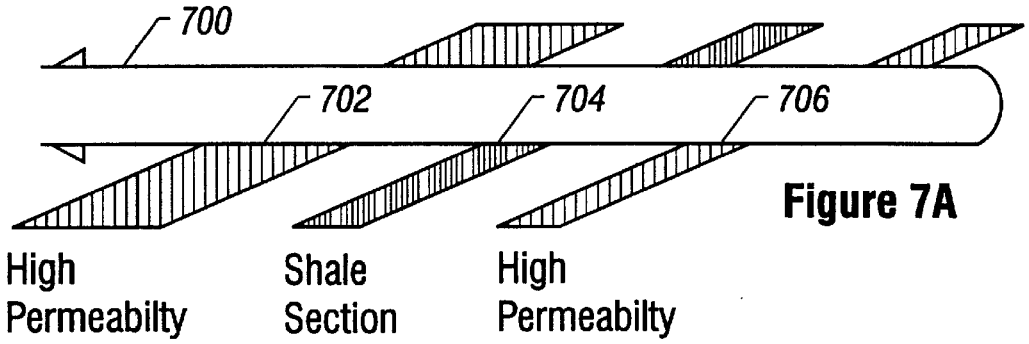
FIG. 7 shows an alternative method of equalizing production from a reservoir by a horizontal wellbore to the method of system of FIG. 1
Figure 7B:
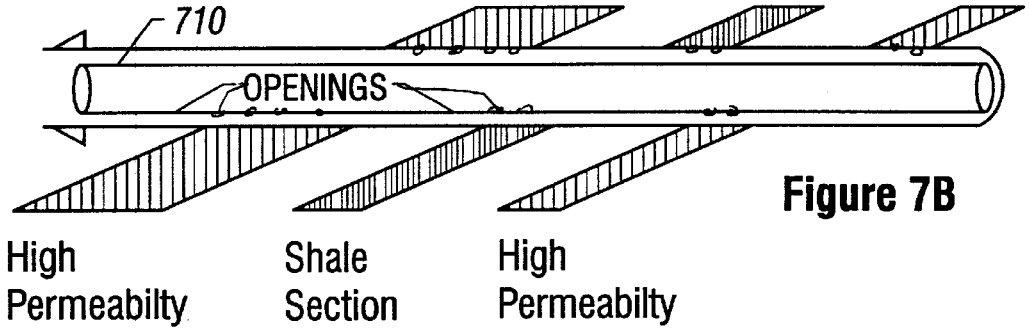
Figure 7C:
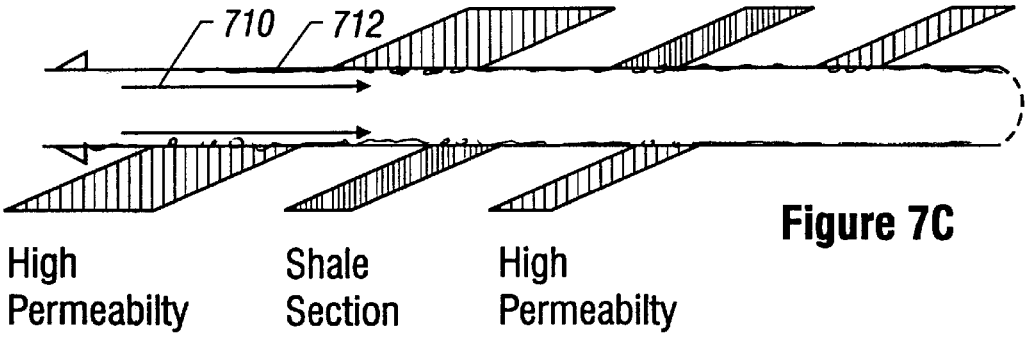

FIG. 7A–7C show an alternative method of equalizing production from a horizontal wellbore. FIG. 7A shows a horizontal wellbore with zones 702, 704 and 706 having different or contrasting permeabilities. The desired production from each of the zones is determined according to the reservoir model available for the wellbore 700, as described above. To achieve equalized production from the various zones, a flow control device 710 in the form of a relatively thin liner is set in the wellbore 700. The liner 710 has openings corresponding to the areas that are selected to be produced in proportion to the desired flow rates from such areas. The openings are preferably set or made at the surface prior to installation of the liner 710 in the wellbore. To install the liner 710, an expander device (not shown) is pulled through the inside of the liner 710 to create contact between the formation 700 and the liner 710. A sand control liner 712 is then run in the wellbore to ensure borehole stability when the wellbore is brought to production. Thus, in one aspect, this method comprises: drilling and logging a wellbore; determining producing and isolated intervals of the wellbore; installing reservoir inflow control system; installing a production liner in the wellbore; installing a production tubing in the wellbore; and producing formation fluids.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A system for producing formation fluid through a production tubing in a wellbore formed in a subsurface formation, comprising:

(a) at least one fluid flow device disposed in the wellbore, said at least one fluid flow device having a fluid flow line with a tortuous fluid flow path for reducing pressure between an inlet receiving the formation fluid from the subsurface formation and an outlet discharging the received formation fluid into the production tubing;

(b) a flow regulation device for controlling discharge of the formation fluid from the fluid flow line into the production tubing; and (c) a control unit for controlling the operation of the flow regulation device to control the fluid flow into the production tubing.

2. The system of claim 1, wherein the at least one fluid flow device includes a plurality of spaced apart fluid flow devices arranged serially in the wellbore.

3. The system of claim 2, wherein the control unit controls the flow of the formation fluid through each fluid flow device in said plurality of spaced apart fluid flow devices.

4. The system of claim 2, wherein the control unit independently controls each fluid flow device to substantially uniformly deplete the formation fluid from the subsurface formation.

5. The system of claim 1, wherein the fluid flow line is a helically arranged tubing for providing the tortuous fluid flow path for the flow of the formation therethrough.

6. The system of claim 1, wherein the at least one fluid flow device includes a plurality of fluid flow lines, each having a tortuous fluid flow path and wherein the control unit controls the flow of the formation fluid through each said fluid flow line.

7. The system of claim 1, wherein the control unit controls the operation of the flow regulation device in response to receiving a command signal from a remote location.

8. The system of claim 1 further comprising a sensor in the wellbore for providing measurements for a downhole production parameter.

9. The system of claim 8, wherein the control unit operates the flow regulation device as a function of the downhole production parameter.

10. The system of claim 9, wherein the downhole production parameter is selected from a group consisting of (i) temperature, (ii) pressure, (iii) fluid flow rate, and (iv) resistivity.

11. The system of claim 1, wherein the control unit is located at a suitable location selected from the a group consisting of (i) at the surface, and (ii) in the wellbore.

12. A method of producing formation fluid contained in a subsurface formation via a production tubing disposed in a wellbore formed from a surface location into the subsurface formation, said method comprising:

(a) flowing the formation fluid from the subsurface formation into the production tubing via at least one fluid flow device that includes at least one flow line having a tortuous fluid flow path that reduces pressure of the formation fluid as the formation fluid flows through said fluid flow line from the subsurface formation to the production tubing; and (b) controlling the flow rate of the formation fluid flowing through the at least one fluid flow line to control discharge of the formation fluid into the production tubing.

13. The method of claim 12 further comprising flowing the formation fluid from the subsurface formation via a plurality of fluid flow devices spaced apart along a length of the wellbore, wherein each said fluid flow device includes an associated fluid flow line with a tortuous fluid flow path.

14. The method of claim 13 further comprising independently controlling fluid flow through each said fluid flow device to substantially uniformly deplete the formation fluid from the subsurface formation.

15. The method of claim 12, wherein controlling the flow rate of the formation fluid comprises;

(i) providing a flow regulation device in said fluid flow line; and (ii) controlling said flow regulation device to control the flow of the formation fluid into the production tubing.

16. The method of claim 15, wherein controlling said flow regulation device comprises controlling the flow regulation device by a control unit.

17. A The method of claim 16, wherein the control unit is disposed at a location selected from a group consisting of (i) a location at the surface, and (ii) in the wellbore.

* * * * *